US006158189A

United States Patent [19]

Lau

[11] Patent Number: 6,158,189

[45] Date of Patent: Dec. 12, 2000

[54] WOODEN I-BEAM AND WOODEN STRUCTURAL BEAM AND BRIDGING ASSEMBLY

[75] Inventor: Wing Cheong Lau, Gloucester, Canada

[73] Assignee: Alpa Roof Trusses Inc., Maple, Canada

[21] Appl. No.: 09/283,212

[22] Filed: Apr. 1, 1999

[51] Int. Cl.[7] ..... E04C 3/12

[52] U.S. Cl. ..... 52/729.4; 52/730.7; 52/730.1; 52/690; 52/693

[58] Field of Search ..... 52/729.4, 730.1, 52/693, 650.1, 690, 730.7, 731.1

[56] References Cited

U.S. PATENT DOCUMENTS

| | | | |
|---|---|---|---|
| 4,207,719 | 6/1980 | Knowles . | |
| 4,228,631 | 10/1980 | Geffe . | |
| 4,525,974 | 7/1985 | Steidle-Sailer et al. . | |
| 5,267,425 | 12/1993 | Onysko et al. . | |
| 5,560,177 | 10/1996 | Brightwell . | |
| 5,664,393 | 9/1997 | Veilleux et al. . | |
| 5,761,872 | 6/1998 | Sanford | 52/694 |
| 5,867,962 | 2/1999 | Scott | 52/696 |
| 5,927,036 | 7/1999 | Matthews | 52/483.1 |
| 6,018,921 | 2/2000 | Lindsay | 52/690 |

*Primary Examiner*—Beth A. Stephan
*Attorney, Agent, or Firm*—Trevor C. Klotz

[57] ABSTRACT

An engineered or manufactured elongate wooden I-beam of the type having continuous upper and lower flange sections and a central web section therebetween is provided with a rectangular opening in the web along the span of the beam. A rectangular and open reinforcing frame constructed from at least four wooden pieces is securely positioned in the opening and is exteriorly dimensioned so that the height of the frame corresponds to the distance between the opposed interfaces of the upper and lower flange sections and the width of the frame is no less than the distance between the spaced apart web sections. This reinforced opening facilitates the passage of ductwork or the like laterally therethrough. Employing apertured I-beams of the foregoing description also facilitates a structural beam and bridging assembly where an elongate wooden bridging element can be employed by extending through and being interconnected to the frames of adjacent pairs of apertured joists.

22 Claims, 2 Drawing Sheets

WOODEN I-BEAM AND WOODEN STRUCTURAL BEAM AND BRIDGING ASSEMBLY

FIELD OF INVENTION

This invention relates to a manufactured wooden I-beam which is provided with an opening that extends through the sidewalls of the beam and also relates to a wooden structural beam and bridging assembly employing parallel and spaced apart elongate wooden I-beams of the foregoing description.

BACKGROUND OF INVENTION

Manufactured elongate wooden I-beams of the type to which the novel I-beam of this invention relates are well known in the art. Typical wooden I-beams each have continuous upper and lower flange or chord sections held in spaced apart relationship by being securely fastened to a central web section which extends along the full length of the beam so as to impart to it, in a cross-section, the "I" configuration. Fabricated wood I-beams use less wood and are usually lighter than regular sawn lumber used in similar applications such as floor joist and ceiling or roof rafters.

One of the more critical parameters governing the design of a wooden I-beam is the tension capacity of the bottom chord of the beam. Under normal uniform loading conditions, the requirement for the tension capacity is the greatest at the center of the span of the beam. The central region is therefore a critical region for strength design.

Still another important consideration is vibration performance. Means for improving the vibration performance of wooden I-beam floors, include the provision of bridging elements installed transversely between adjacent pairs of floor joists. However, conventional bridging elements such as cross-braces are not recommended for use with wooden I-beams, and solid blocking can be ineffective due to wood shrinkage. Other bridging systems have been developed, but are generally more costly to install.

In order to optimize ceiling height where wooden I-beams are employed as the joist, it is not uncommon for installers of duct work which must run transversely of the joist, to cut rectangular openings in the continuous web of the I-beams in order to permit the duct work to extend therethrough. Needless to say, the structural integrity and loading capability of I-beams cut open in this manner is compromised.

In U.S. Pat. 5,664,393, Veilleux, et al issued Sep. 9, 1997 there is provided a wooden I-beam having upper and lower chords and an open web structure joining the chords. The web is made up of a series of trapezoidal laminated panels which define a series of triangular spacing therebetween. These spacings permit the passage of electrical cable and piping therethrough, but not large sized objects such as ductwork as used for heating or air conditioning. Moreover, the Veilleux beam, as well as a box like beam having triangular openings in the sidewalls as disclosed in U.S. Pat. 4,228,631, Geffe, issued Oct. 21, 1980, is relatively expensive to construct when compared to conventional wooden I-beams.

While a portion of the web section of a regular wood I-beam may be cut out so as to accommodate ductwork, there is no provision for properly reinforcing the enlarged opening. Indeed, if an opening in the web is cut out in the field in order to accommodate ductwork or the like, one may attempt to reinforce the I-beam by nailing a vertical member to the sidewalls of the upper and lower flanges proximate one or both sides of the opening, or possibly positioning and nailing a vertical member to the opposing inner faces of the flanges along one or both of the sidewalls of the opening. This type of field modification is normally not followed because of the expense involved, and the necessity of obtaining requisite engineering approvals for such changes.

SUMMARY OF THE INVENTION

In accordance with one aspect of this invention, the manufactured elongate wooden I-beam, at the time of fabrication, is provided with an aperture or opening extending through the beam sidewall. To this end, two aligned and spaced apart web sections are disposed between and extend centrally along the length of the flanges to which they are attached to thereby provide an opening of predetermined size which extends through a side of the I-beam at a predetermined location intermediate the ends of the I-beam. The opening itself can thus be reinforced at the time of manufacture by a rectangular and open reinforcing frame constructed from at least four wooden frame pieces disposed in the rectangular opening. The rectangular frame is exteriorly dimensioned so that the height of the frame is no greater than, and preferably equal to, the distance between the opposed inner faces of the upper and lower flanges of the I-beam, and the width of the frame is no less than the distance between the spaced apart web sections.

Wooden I-beams prefabricated in the foregoing manner lessen the chance of errors made by on-site construction crews, since they are not required to make openings in the web on-site. Additionally, and as discussed hereinbelow, the reinforced web opening as contemplated by this invention permits an increase in span rating of the apertured I-beam, or a lowering of the grade of wood used for the flange members in the I-beam.

Preferably, the wooden frame pieces making up the open rectangular frame each has cross-sectional dimensions which corresponds to the cross-sectional dimensions of the upper and lower flange sections. It is also preferable that the top and bottom wooden pieces of the rectangular and open reinforcing frame be respectively securely fastened, such as by gluing, to the opposed inner faces of the upper and lower flange sections, and that the wooden side pieces of the rectangular frame extend between the top and bottom wood frame pieces. It will be appreciated that the upper and lower wooden pieces of the open rectangular frame, once attached, form an integral part with the respective top and bottom flanges.

The opposed inner faces of the upper and lower flanges are normally each provided with a centrally located and longitudinally extending groove to respectively receive the upper and lower margins of the web which is positioned therein. Since the top and bottom wooden pieces extend between the two spaced apart web sections, if desired, the exterior faces of the top and bottom wooden pieces can each be provided with a centrally located and longitudinally extending tongue so as to be respectively received in the grooves provided in the upper and lower flanges. To this end, while the wood stock used for the flanges and the wood rectangular open frame may have the same cross-sectional dimensions, the exterior faces of the top and bottom wood pieces which abut the faces of the opposed flanges can be cut down so as to form the tongue.

In keeping with the novel I-beam of this invention, it will also be appreciated that the exterior faces of the sides of the rectangular and open reinforcing frame can be respectively provided with an elongate groove for receiving an end portion of an adjacent web section and that, if desired, the two can be glued together within the groove.

The reinforcing frame can be strategically located at or about the mid-span of the beam, given that the bending moment in the beam is the greatest in this area under normal uniform loading conditions. By having the top and bottom wood pieces of the frame connected to the top and bottom flange of the I-beam through an adhesive joint, the combined members work together to resist the bending moment in the beam within the connected region. Such an arrangement therefore can increase the amount of load the reinforced beam can carry, or reduce the grade quality of the flange members, or increase the span rating allowable for such a beam.

The length of the upper and lower wooden pieces of the open rectangular frame depends on the extent of reinforcement required, taking into account the grade of flange members desired to be used, and the beam span targeted. As evident from that which follows, a lower-grade lumber can be used in the top and bottom flange of an I-beam constructed with an open rectangular frame as above-described, than an equivalent I-beam not having an open rectangular frame insert, for a given beam span.

Employing the working-stress design method as used by BOCA (Building Officials And Code Administration International, Inc.) by way of example, and assuming that the tension strength of the bottom flange at the side exterior edge of the reinforcing rectangular open frame governs the design of the beam, the optimum length of the upper and lower reinforcing members of a rectangular and open wood frame centered at the beam mid-span can be determined according to the following expression:

$$f_t = \left(\frac{w}{8}\right)\frac{s^2 - l^2}{a\,b\,(d-b)} \tag{1}$$

where $f_t$ is the actual tension stress of the I-beam flange material, l is the length of the reinforcing members of the frame, S is the span of the beam, w is the uniform load per unit length; a is the width dimension of the flange, b is the depth dimension of the flange, and d is the depth of the I-beam. It can be observed from Equation 1 that as l is increased, $f_t$ is reduced. Therefore a lower-grade of flange may be substituted in place of a higher-grade of flange by increasing the length l.

Rearranging the terms in Equation 1, and substituting $f_t$ by $F'_t$, where $F'_t$ is the allowable tensile stress including applicable strength modification factors of the I-beam flange material, one can see that:

$$s = \sqrt{l^2 + \frac{8}{w}F'_t\,a\,b(d-b)} \tag{2}$$

which indicates that for a given $F'_t$, the span may be increased by l. This is not to say that one can increase the span S without limit, because other design criteria will govern eventually. For example, the span may be limited by the allowable moment at mid-span such that $$s = \sqrt{\frac{8}{w}F'_t\,a\,b'(d-b')} \tag{3}$$

where b' is the combined depth dimension of the flange and the reinforcing members and where the width of the reinforcing members is also a. It should be noted that when there is no reinforcing members, S reaches a maximum given by $$s = \sqrt{\frac{8}{w}F'_t\,a\,b(d-b)} \tag{4}$$

which is less than the span given by either Equation 2 or 3.

There is yet another consideration when determining the size of the frame insert. The length of the opening could be limited by a combined stress criterion. As an example, one such criterion for the bottom flange member is:

$$\frac{f_t}{F'_t} + \frac{f_v}{F'_v} + \frac{f_b}{F'_b} \le 1 \tag{5}$$

where $f_t$, $f_v$ and $f_b$ are the actual tensile, shear and bending stresses resulting from the applied load, and $F'_t$, $F'_v$ and $F'_b$ are the respective allowable tensile, shear and bending stresses including applicable strength modification factors of the combined flange and reinforcing lower members.

It may so happen that the maximum width of the opening in accordance with Equation 5 is less than the length of the reinforcing member in accordance with Equation 1. This problem can be overcome in the present invention by simply using more than one vertical side pieces of the same dimensions or larger single side piece to reduce the width of opening of the reinforcing frame.

Apertured I-beams each having a rectangular and open reinforcing framework as above described are also suitable for use in wooden I-beam and bridging structural assemblies due to the fact that the inner faces of the rectangular and open frame, and preferably the interior wooden side pieces thereof, can advantageously serve as anchor points for a bridge element which extends between the apertures of two or more adjacent I-beams and which preferably is in the form of a single wooden structural member such as a piece of 2"×4" lumber spanning over several joists, and which is otherwise known in the art as a "strongback". Preferably, in situ, it is positioned with its narrow face parallel to the plane of the floor. Such an installed bridging element or strongback acts like a "beam", inter-connecting adjacent pairs of apertured joists at their respective reinforced web openings. Additionally a strongback is more cost-effective than standard cross-bracing or blocking, and does not impart any loading directly on to the joint between the web and the lower flange of the beam. Normally, a strongback cannot be used with a typical wood I-beam floor system.

The novel I-beams each having a rectangular and open reinforcing framework as above described are superior to conventional wooden I-beams in fire endurance because the frame members provide additional sacrificial wood to burn where it is most needed in the flange members. The vertical side pieces of the reinforcing frame also serve to hold the top and bottom flange members together longer when exposed to fire, than a beam without the reinforcing frame. Additionally, in situations where sprinklers are installed between adjacent joists to protect the floor system from fire hazards, the prefabricated opening in the novel I-beams allow easy access of sprinkled water from one joist space to adjacent joist spaces through the openings, thus providing better coverage of the flange members where it is most needed.

DETAILED DESCRIPTION OF THE DRAWINGS

Figure 1:
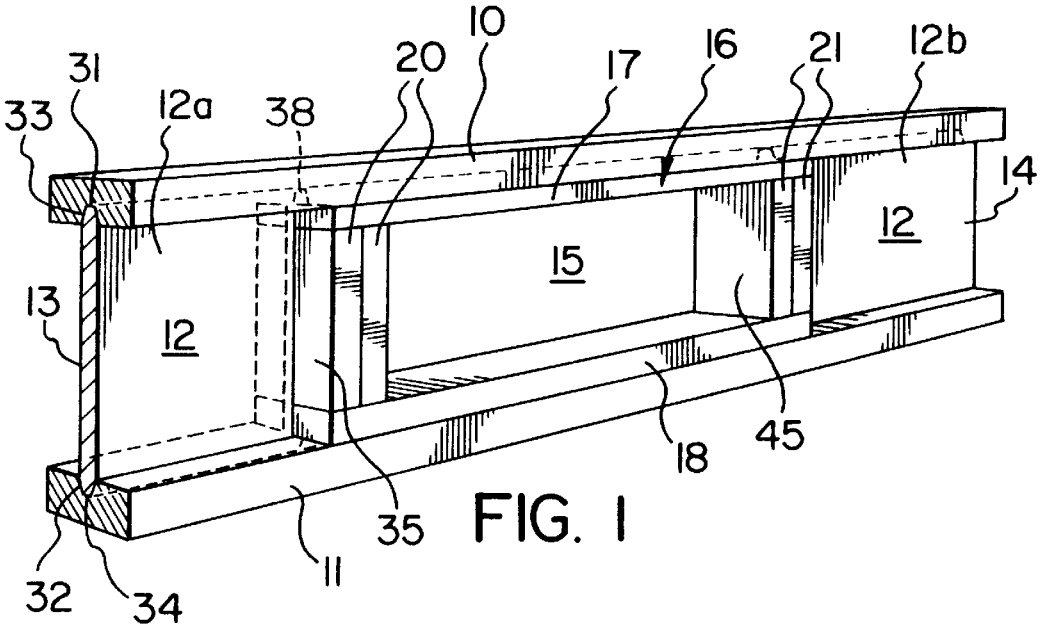
FIG. 1 is a perspective view of a relatively short length wooden I-beam illustrating a rectangular opening extending through the sidewall thereof and which is surrounded by an open rectangular framework.
Figure 2:
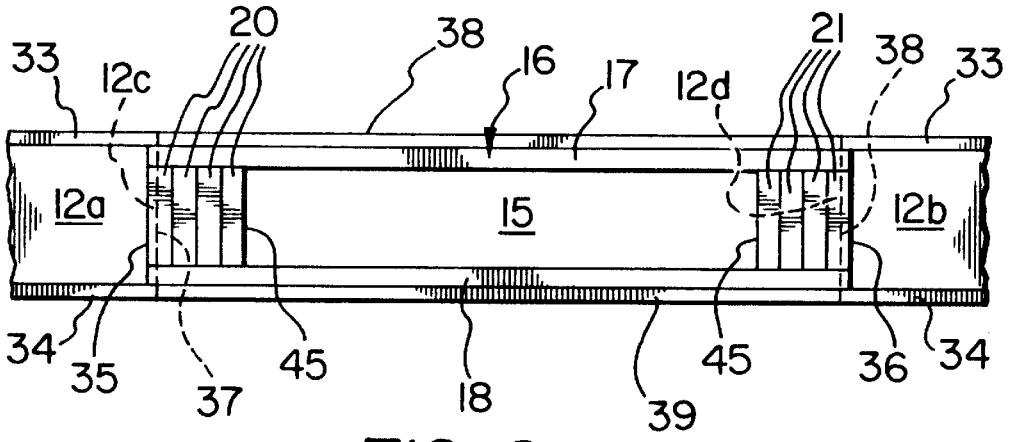
FIG. 2 is a side elevational view of an open rectangular wood framework similar to that as seen in FIG. 1 and wherein the upper and lower flanges have been removed to better illustrate the tongues on the top and bottom frame pieces, and the interconnection of the opposed web sections to the sides of the rectangular framework.

With reference to the accompanying drawings and more particularly FIGS. 1 and 2, each I-beam constructed in accordance with this invention is similar to conventional wooden I-beams as is well known in the art and which basically comprises a wooden upper flange 10, a wooden lower flange 11 and relatively thin web section 12 disposed therebetween. Elongate grooves 31 and 32 are provided in and extend along the opposed inner faces of upper and lower flanges 10 and 11, so as to receivingly engage the tapered upper and lower margins 33 and 34 of web 12.

Intermediate the two ends 13 and 14 of each I-beam there is provided a rectangular opening 15 extending through the sidewall of the wooden I-beam and which is circumscribed by a rectangular and open wooden framework generally designated by reference number 16 in the drawings.

The rectangular open frame 16, as constructed, is preferably made up from individual top and bottom wooden frame pieces 17 and 18, the cross-sectional dimensions of which are preferably the same as upper and lower flanges 10 and 11, and the length of which is no less than the distance between the opposed ends 12*c* and 12*d* of spaced apart web sections 12*a* and 12*b* of the I-beam as seen in FIG. 2.

Figure 3:
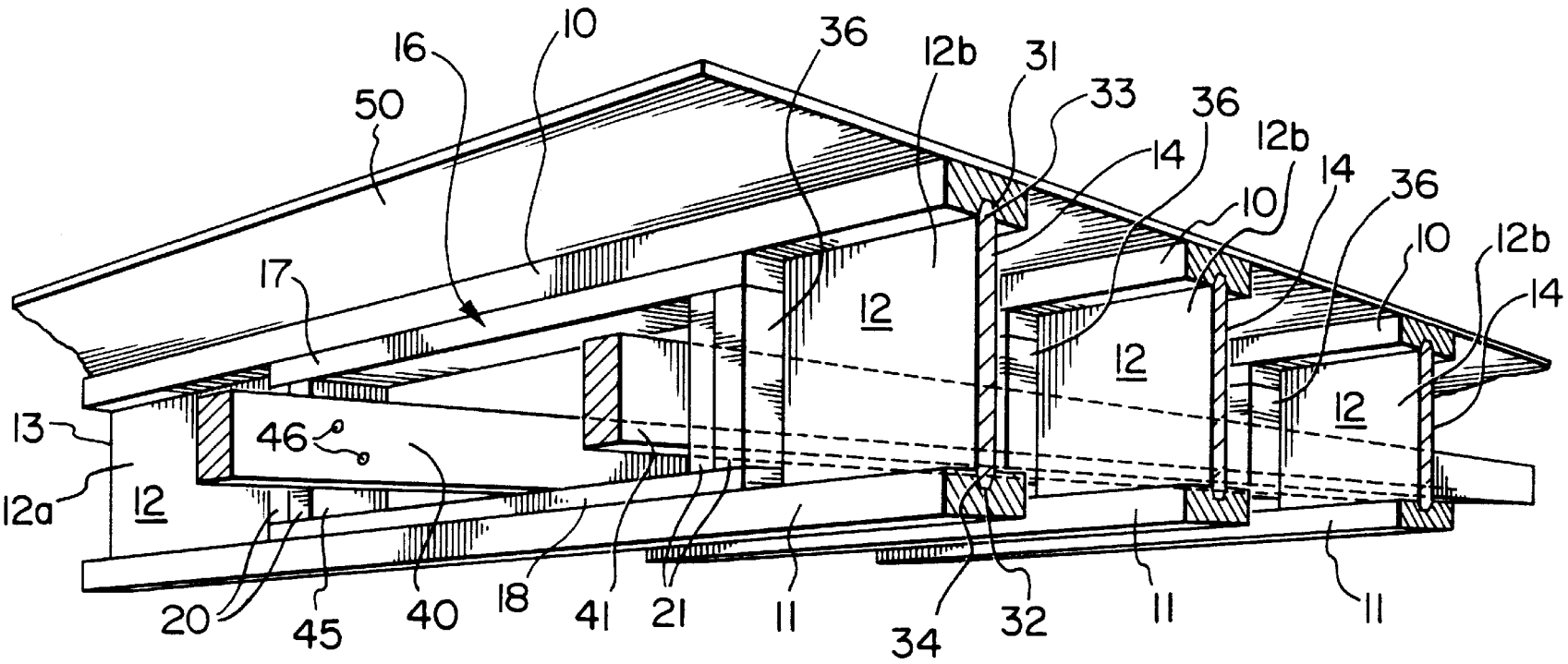
FIG. 3 is a bottom and side perspective view of a wooden structural I-beam and bridging assembly utilizing I-beams of the type depicted in FIGS. 1 and 2, and which are transversely interconnected by strongbacks extending through the reinforced apertures.

One or more wooden side pieces forming part of the rectangular and open wooden frame 16 are preferably disposed between top and bottom frame pieces 17 and 18; with two left hand pieces 20 and two right hand pieces 21 being shown in FIGS. 1 and 3, and four such pieces on either side being shown in FIG. 2. The exterior faces of top and bottom wood pieces 17 and 18 of frame 16 as seen in FIGS. 1 and 3, are respectively securely fastened to the opposed inner faces of the upper and lower flange sections 10 and 11 by any suitable means, such as by gluing. Exterior sidewall faces 35 and 36 can each advantageously be provided as seen in FIG. 2, with an elongate grooves 37 and 38 therein to receivingly engage the opposed free ends 12*c* and 12*d* of web sections 12*a* and 12*b*, and which again can be securely fastened thereto by any suitable means, such as gluing.

As also seen in FIG. 2, like the tapered upper and lower margins 33 and 34 of web sections 12*a* and 12*b*, the exterior faces of the top and bottom pieces 17 and 18 can each respectively be provided with tongues 38 and 39 for insertion into grooves 31 and 32 provided in upper and lower flanges 10 and 11.

FIG. 3 illustrates a wooden structural I-beam and bridging assembly constructed from three parallel and spaced apart wooden I-beams, each one of which is similar to that as shown in FIG. 1, and also illustrates two wooden bridging elements 40 and 41 which extend through the aligned apertures of each I-beam. These bridging elements or "strongbacks" are each securely fastened to an interior sidewall 45 of the open rectangular frame as shown by any suitable attachment means, such as nails 46.

It will be appreciated that strongbacks 40 and 41 inhibit vertical and lateral deflection of the I-beams and thus reduce vibration imparted to the I-beams when overlying floor or sub-floor 50 is subjected to loading impacts.

I claim:

1. A wooden structural beam and bridging assembly comprising:

(a) a plurality of manufactured elongate wooden I-beams disposed in parallel and spaced apart relation, (b) each of said I-beams being of like construction and having continuous upper and lower flange sections and two aligned and spaced apart web sections disposed therebetween and which extend centrally along the length of said flanges so as to securely fasten the upper and lower flange sections together and to provide a rectangular opening of predetermined size which extends through a side of the I-beam at a predetermined location intermediate the ends of said I-beam;

(c) each said I-beam further having a rectangular and open reinforcing frame constructed from at least four wooden pieces, said frame being securely disposed in said rectangular opening and being exteriorly dimensioned so that the height of said frame corresponds to the distance between the opposed inner faces of said upper and lower flange sections and the width of said frame is no less than the distance between said spaced apart web sections; and (d) at least one elongate wooden bridging element which extends transversely through and which is securely fastened to said rectangular and open reinforcing frame of adjacent I-beams.

2. The structural beam and bridging assembly as claimed in claim 1, wherein each wooden piece is made up from wood stock having the same cross-sectional dimensions as said upper and lower flange sections.

3. The structural beam and bridging assembly as claimed in claim 1, wherein the exterior faces of top and bottom wooden pieces of said rectangular and open reinforcing frame are each provided with a centrally located and longitudinally extending tongue which projects therefrom and which are respectively received in centrally located and longitudinally extending grooves in each of the opposed inner faces of said upper and lower flanges.

4. The structural beam and bridging assembly as claimed in claim 1, wherein the exterior faces of the top and bottom wooden pieces of said rectangular and open reinforcing frame are respectively securely fastened to the opposed inner faces of said upper and lower flange sections and correspond in length to said exterior width of said reinforcing frame, and said wooden side pieces of said frame extend between said top and bottom pieces.

5. The structural beam and bridging assembly as claimed in claim 2, wherein the exterior faces of the top and bottom wooden pieces of said rectangular and open reinforcing frame are respectively securely fastened to the opposed inner faces of said upper and lower flange sections and correspond in length to said exterior width of said reinforcing frame, and said wooden side pieces of said frame extend between said top and bottom pieces.

6. The structural beam and bridging assembly as claimed in claim 3, wherein the exterior faces of the top and bottom wooden pieces of said rectangular and open reinforcing frame are respectively securely fastened to the opposed inner faces of said upper and lower flange sections and correspond in length to said exterior width of said reinforcing frame, and said wooden side pieces of said frame extend between said top and bottom pieces.

7. The structural beam and bridging assembly as claimed in claim 1, wherein the exterior faces of the sides of said rectangular and open reinforcing frame are respectively provided with an elongate groove for receiving an end portion of an adjacent web section.

8. The structural beam and bridging assembly as claimed in claim 7, wherein the exterior side faces of said rectangular and open reinforcing frame are respectively glued along said groove to said end portion of said adjacent web section.

9. The structural beam and bridging assembly as claimed in claim 1, wherein the exterior faces of the top and bottom wooden pieces of said frame are securely fastened by gluing to the opposed inner faces of said upper and lower flange sections and correspond in length to the exterior width of said reinforcing frame, said wooden side pieces of said frame extend between said top and bottom pieces, and the exterior faces of the sides of said frame are respectively provided with a centrally located elongate groove for securely receiving by gluing an end portion of an adjacent web section.

10. The structural beam and bridging assembly as claimed in claim 2, wherein the exterior faces of the top and bottom wooden pieces of said frame are securely fastened by gluing to the opposed inner faces of said upper and lower flange sections and correspond in length to the exterior width of said reinforcing frame, said wooden side pieces of said frame extend between said top and bottom pieces, and the exterior faces of the sides of said frame are respectively provided with a centrally located elongate groove for securely receiving by gluing an end portion of an adjacent web section.

11. The structural beam and bridging assembly as claimed in claim 3, wherein the exterior faces of the top and bottom wooden pieces of said frame are securely fastened by gluing to the opposed inner faces of said upper and lower flange sections and correspond in length to the exterior width of said reinforcing frame, said wooden side pieces of said frame extend between said top and bottom pieces, and the exterior faces of the sides of said frame are respectively provided with a centrally located elongate groove for securely receiving by gluing an end portion of an adjacent web section.

12. A manufactured elongate wooden I-beam comprising:

(a) a continuous upper flange and continuous lower flange;

(b) two aligned and spaced apart web sections disposed between and which extend centrally along the length of the said flanges so as to securely join the upper and lower flanges together and to provide a rectangular opening of predetermined size which extends through a side of said I-beam at a predetermined location intermediate the ends of said I-beam;

(c) said I-beam further comprising a rectangular and open reinforcing frame constructed from at least four wooden frame pieces, said frame being securely disposed in said rectangular opening and being exteriorly dimensioned so that the height of said frame corresponds to the distance between the opposed inner faces of said upper and lower flanges and the width of the frame is no less than the distance between said spaced apart web sections.

13. The manufactured elongate wooden I-beam as claimed in claim 12, wherein the cross-sectional dimensions of each said wooden piece corresponds to the cross-sectional dimensions of said upper and lower flange sections.

14. The manufactured elongate wooden I-beam as claimed in claim 12, wherein the exterior faces of the top and bottom wooden pieces of said rectangular and open reinforcing frame are each provided with a centrally located and longitudinally extending tongue which projects therefrom and which are respectively received in centrally located and longitudinally extending grooves in each of the opposed inner faces of said upper and lower flanges.

15. The manufactured elongate wooden I-beam as claimed in claim 12, wherein the exterior faces of the top and bottom wooden pieces of said rectangular and open reinforcing frame are respectively securely fastened to the opposed inner faces of said upper and lower flange sections, and correspond in length to said exterior width of said frame, and the wooden side pieces of said frame extend between said top and bottom wooden pieces.

16. The manufactured elongate wooden I-beam as claimed in claim 13, wherein the exterior faces of the top and bottom wooden pieces of said rectangular and open reinforcing frame are respectively securely fastened to the opposed inner faces of said upper and lower flange sections, and correspond in length to said exterior width of said frame, and the wooden side pieces of said frame extend between said top and bottom wooden pieces.

17. The manufactured elongate wooden I-beam as claimed in claim 14, wherein the exterior faces of the top and bottom wooden pieces of said rectangular and open reinforcing frame are respectively securely fastened to the opposed inner faces of said upper and lower flange sections, and correspond in length to said exterior width of said frame, and the wooden side pieces of said frame extend between said top and bottom wooden pieces.

18. The manufactured elongate wooden I-beam as claimed in claim 12, wherein the exterior faces of the sides of said rectangular and open reinforcing frame are respectively provided with an elongate groove for receiving an end portion of an adjacent web section.

19. The manufactured elongate wooden I-beam as claimed in claim 18, wherein the exterior side faces of said rectangular and open reinforcing frame are respectively glued along said groove to said end portion of said adjacent web section.

20. The manufactured wooden I-beam as claimed in claim 12, wherein the exterior faces of the top and bottom wooden pieces of said frame are securely fastened by gluing to the opposed inner faces of said upper and lower flange sections and correspond in length to the exterior width of said frame, said wooden side pieces of said frame extend between said top and bottom pieces, and the exterior faces of the sides of the frame are respectively provided with a centrally located elongate groove for securely receiving by gluing an end portion of an adjacent web section.

21. The manufactured wooden I-beam as claimed in claim 13, wherein the exterior faces of the top and bottom wooden pieces of said frame are securely fastened by gluing to the opposed inner faces of said upper and lower flange sections and correspond in length to the exterior width of said frame, said wooden side pieces of said frame extend between said top and bottom pieces, and the exterior faces of the sides of the frame are respectively provided with a centrally located elongate groove for securely receiving by gluing an end portion of an adjacent web section.

22. The manufactured wooden I-beam as claimed in claim 14, wherein the exterior faces of the top and bottom wooden pieces of said frame are securely fastened by gluing to the opposed inner faces of said upper and lower flange sections and correspond in length to the exterior width of said frame, said wooden side pieces of said frame extend between said top and bottom pieces, and the exterior faces of the sides of the frame are respectively provided with a centrally located elongate groove for securely receiving by gluing an end portion of an adjacent web section.

* * * * *